US005246136A

United States Patent [19]

Loidl

[11] Patent Number: 5,246,136

[45] Date of Patent: Sep. 21, 1993

[54] APPARATUS FOR STORAGE AND TIMED TAKING OF MEDICAMENTS

[76] Inventor: Rudolf Loidl, Brucknerstrasse 6/21A, A-4600 Wels, Austria

[21] Appl. No.: 848,980

[22] PCT Filed: Oct. 18, 1990

[86] PCT No.: PCT/AT90/00103

§ 371 Date: Apr. 17, 1992

§ 102(e) Date: Apr. 17, 1992

[87] PCT Pub. No.: WO91/05535

PCT Pub. Date: May 2, 1991

[30] Foreign Application Priority Data

Oct. 20, 1989 [AT] Austria ..... 2412/89

[51] Int. Cl.[5] ..... B65D 83/00

[52] U.S. Cl. ..... 221/3; 221/2; 221/7; 221/15; 221/76

[58] Field of Search ..... 221/2, 3, 5, 7, 8, 15, 221/76, 83, 91; 206/534, 538, 539

[56] References Cited

U.S. PATENT DOCUMENTS

| | | | |
|---|---|---|---|
| 2,258,866 | 10/1941 | Sanford . | |
| 2,828,005 | 3/1958 | Riche . | |
| 4,223,801 | 9/1980 | Carlson | 221/15 |
| 4,572,403 | 3/1986 | Benaroya . | |
| 4,674,651 | 6/1987 | Scidmore et al. | 221/3 |
| 4,838,453 | 6/1989 | Luckstead | 221/2 |

FOREIGN PATENT DOCUMENTS

| | | | |
|---|---|---|---|
| 0159306 | 10/1985 | European Pat. Off. . | |
| 1092991 | 8/1982 | United Kingdom . | |
| 2199308 | 7/1988 | United Kingdom | 221/3 |

*Primary Examiner*—H. Grant Skaggs

*Attorney, Agent, or Firm*—Salter, Michaelson & Benson

12 Claims, 4 Drawing Sheets

APPARATUS FOR STORAGE AND TIMED TAKING OF MEDICAMENTS

The invention relates to an apparatus for storage and timed taking of medicaments in form of portioned particles, for example pills, coated tablets or capsules, in particular birth control pills, comprising a storage means for the medicaments to be taken and an adjustable electronic signal transmitting means for actuating alarm signals at the desired moment for taking the medicament, the storage means being provided with a plurality of receiving openings for the medicaments to be taken over a time interval of some days, said receiving openings being disposed in a circle around a rotation center and being covered by a cover member having a dispensing opening, said storage means being rotatable relative to the cover member into different rotary positions related to the receiving openings, in each of which rotary positions one of the receiving openings is disposed near the dispensing opening and, when rotating to a new one of these rotary positions, the signal transmitting means is re-set to a new counting cycle.

For numerous medicaments, in particular for contraception means, it is required to take these medicaments in predetermined continuous time intervals in order to ensure a reliable or optimal effect of the medicament. However, experience shows that, for reasons whatsoever, frequently the medicaments are not taken timely.

Therefore, already an apparatus called "Pill Box Timer" has become known which remembers one at the adjusted moment to take the medicament by means of an adjustable electronic signal transmitter in form of buzzer. This moment can freely be chosen and can be programmed at a timer. After programming the desired moment a starting key must be pressed, whereupon an electronic counter counts downwardly and releases the alarm as soon as it has been counted down to 0. The alarm can be stopped by means of a key. The medicaments are contained in a receiving compartment of the apparatus, which compartment can be closed by a slide cover. The medicament must now be taken and by again pressing the starting key the timer starts to count down to the pre-set alarm moment. Such an apparatus is disadvantageous with some respects: At first, each counting process of the counter controlling the signal transmitter must be released anew by pressing a key, what involves the danger of misoperation, inasmuch the apparatus must comprise more than one key for programming. Further, there is the possibility that more of the medicament than the prescribed dosis is taken by mistake or that pills or the like are lost from the receiving compartment by careless handling.

Within an apparatus of the initially described kind (GB-A 2,092,991), the storage means is formed by a disc being provided with the receiving openings for the medicaments, a further disc forming a cover member and being provided with the dispensing opening is bearingly supported for free rotation on the disc. In one of the compartments of the storage means a micro-processor is disposed for emitting the electric alarm signal at the programable taking moment. Re-set of the counter to a new cycle is made by mere rotation of the cover member. This apparatus has the disadvantage that the cover member can be rotated too easy and therefore also unitentionally or unseen and also in the false direction.

The invention has at its object to avoid the disadvantages of the pre-described known apparatus and to improve an apparatus of the initially described kind so that the medicaments are accommodated in a suitable and protected manner within the apparatus and that erroneous take and misoperation is avoided. The invention solves this task in that the storage means is a rotatable body bearingly supported for rotation around an axis within a casing embracing the rotatable body at least in the region of its receiving openings and having the dispensing opening, said rotatable body, however, protruding from this casing with a handling edge and being arrestable by an interlock means in the different rotary positions, and that an additional rotary position of the rotary body is provided in which no receiving opening is disposed near the dispensing opening, that interlocking means being coupled with the signal transmitting means for re-set to a new counting cycle.

Such an apparatus can very exactly adapted to the prescriptions for taking the medicaments. Whereas within the at first described known apparatus two different operation processes are necessary for quitting the alarm and for taking out the medicament and these two processes have nothing to do with each other so that also medicaments can be taken out if the signal emitter is not in operation and therefore no timed moment for taking the medicament is given, within the inventive apparatus quitting the alarm and initiating a new counter cycle is simultaneously made by simple rotation of the rotary member into the respective next rotary position until the interlocking means arrests this rotary position. Thereby the receiving opening related to this rotary position is brought into coincidence with the dispense opening of the housing so that the medicament positioned within this receiving opening can be released from the apparatus and cen be taken. Therefore, one cannot forget to activate the next counting cycle and always only one portion or, respectively, the amount of the ratio which was in a predetermined manner put into the receiving opening is released, but not more, as long as the rotary member is not stepwisely further rotated, what hardly may happen unintentionally. The medicaments put into the receiving openings are shielded by the housing so that they cannot unintentionally fall out from the housing, and in the dispensing position of the rotary member always only one single receiving opening is ready for taking out the medicament, in contradiction to the first described known apparatus in which all medicaments positioned within the receiving compartment are uncovered after the slide cover has been drawn back. Thereby the medicaments are also better protected against touch, soiling and against being taken out by unauthorized persons, for example children. Above all, however, by the additional rotary position of the rotary member it is ensured that also a series of medicaments which have to be taken over a longer period, can be accommodated completely protected without that there is the danger of an unintentional lost of a medicament through the dispense opening.

In comparison with the second described known construction there is the advantage of an improved security against unintentional rotation of the rotary body because it is no more completely exposed and freely rotatable, but—with the exeption of the grip edge protruding from the housing—is protected by the housing. Simultaneously, a reliable re-set of the signal emitter by its coupling with the locking means is obtained.

Storage means for medicaments in form of a rotary member and positioned within a housing are known per se (U.S. Pat. No. 4,838,453). Further, it is known to interrupt a series of openings for positioning of medicaments in a storage means by a free place. These known apparatus, however, are merely mechanical, they show no possibility to draw the attention of the user to the fact that now there is the moment for taking a medicament.

According to a further embodiment of the invention, a receiving compartment for the medicament is connected to the dispense opening, at the dispensing side of which compartment a closure member movable between a closing position and an open position is provided, in particular a rocker which can be actuated by hand. Thereby, the medicament cannot fall out of the housing also then if the rotary member is rotated unintentionally, because for the real take out of the medicament the separate closure member must be actuated.

According to a preferred embodiment of the invention the interlocking means is formed by a tooth which is resiliently pressed against a toothed ring of the rotary member, what admits to rotate the rotary member in one direction only. Thereby, a mis-operation of the rotary member by rotating it into the inverse direction is prevented in a simple manner. Further, such a construction offers a simple possibility for a coupling between the interlocking means and the signal emitter, namely, if within the spirit of the invention the tooth is carried by a resiliently abutted rocker, which is provided with a normally open contact inserted into a switching circuit of the signal emitter. Upon pressing down this rocker, the switching circuit is closed whereby the electric current flowing in this switching circuit can be used for the desired switching purpose, in particular for quitting the alarm and setting back the counter.

However, within the spirit of the invention there is also the possibility to provide the signal emitter with a counter controlled by the interlocking means for releasing alarm signals at a plurality of subsequent moments for taking, what is possible without any problem in an electronic manner by the use of suitable programs. This shows the advantage that the user must set the desired moment for taking only a few times, if desired only one single time, different moments being possible, for example different times at several days. This enables the user to elastically adapt him to his way of living.

Within a particular suitable embodiment of the invention the housing is provided with a slide cover covering the upper side of the receiving openings of the disc. Such a slide cover is known per se from the initially described apparatus, however, within the invention it has the advantage that it effectively prevents that the medicaments can fall out from the single receiving openings or, respectively, that different medicaments can be mixed (if more than one kind of medicaments is put into the receiving openings). In comparison with a hinged cover there is the advantage that the slide cover—sufficient friction provided—can be less easy unintentionally opened so that an unintentional exit of the medicaments from the housing is not possible.

Within the spirit of the invention a space-saving construction is obtained if the receiving openings are disposed in at least two concentric circles around the center of the disc, several or all circles being provided with an interruption of the series of openings, which interruption in its rotation position over the dispense opening covers this opening completely. The interruption constitutes the input position of the disc in which after removal of the cover the medicaments can be inserted into the single receiving openings.

Within the spirit of the invention a particular favourable construction consists in that between the rotary member and the bottom section of the housing there is disposed a non-rotatable intermediate bottom being intersected by the dispense opening. In such a manner it is possible to provide below the intermediate bottom free spaces in the casing which accommodate operation members, for example the rocker, without that there is the danger that the medicaments fall into these hollow spaces when rotating the rotary body.

Further, it is suitable within the spirit of the invention to provide the casing with a drawer for the accommodation of additional medicaments, for example such medicaments which can compensate side effects, if any, of the medicaments which are regular to be taken.

A further embodiment of the invention consists in that the rocker carries at least one contact inserted into a current circuit of the signal emitter. This contact may serve for special purposes, for example for releasing a separate alarm signal when the rotary member is overrotated for at least one step, and the like.

In the drawing the subject matter of the invention is schematically shown by way of an exemplative embodiment.

Figure 5:
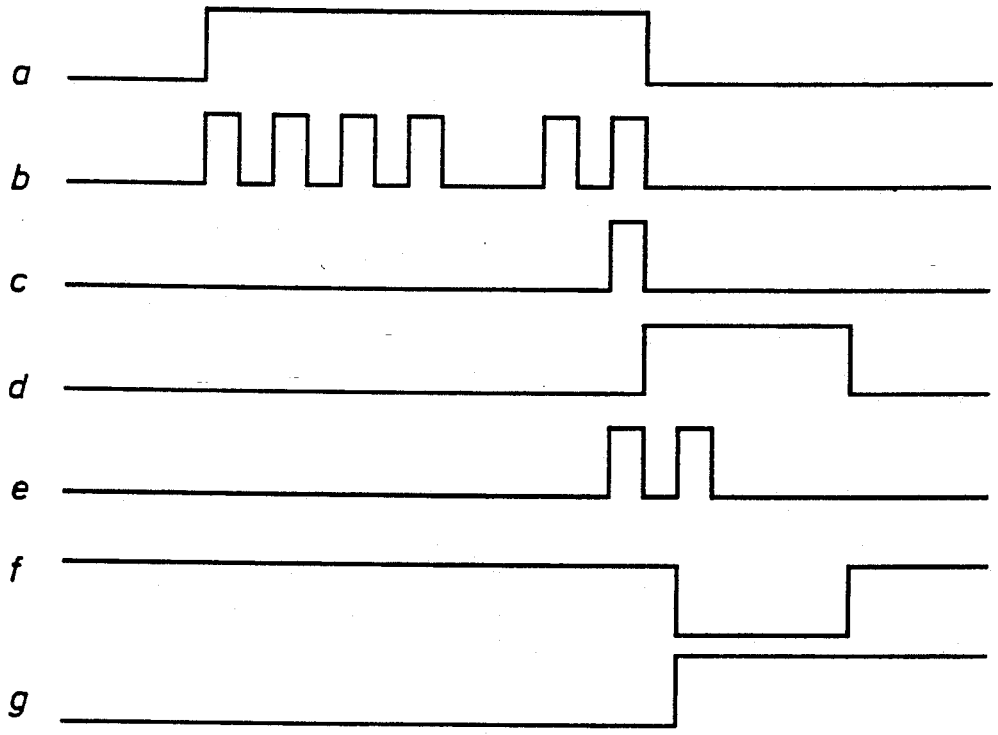
Figure 6:
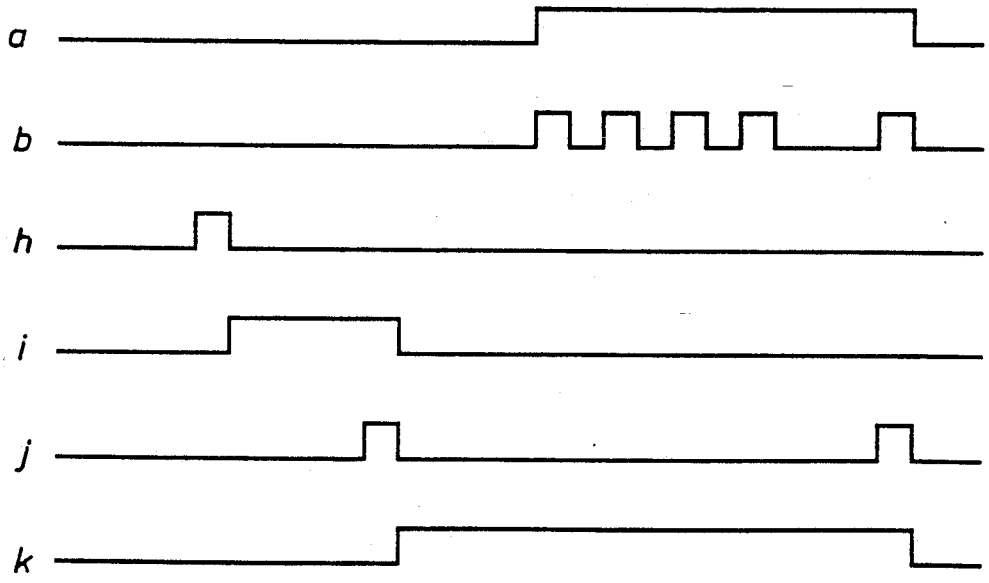

The FIGS. 5 and 6 show pulse diagrams for two abnormal occurences.

Figure 4:
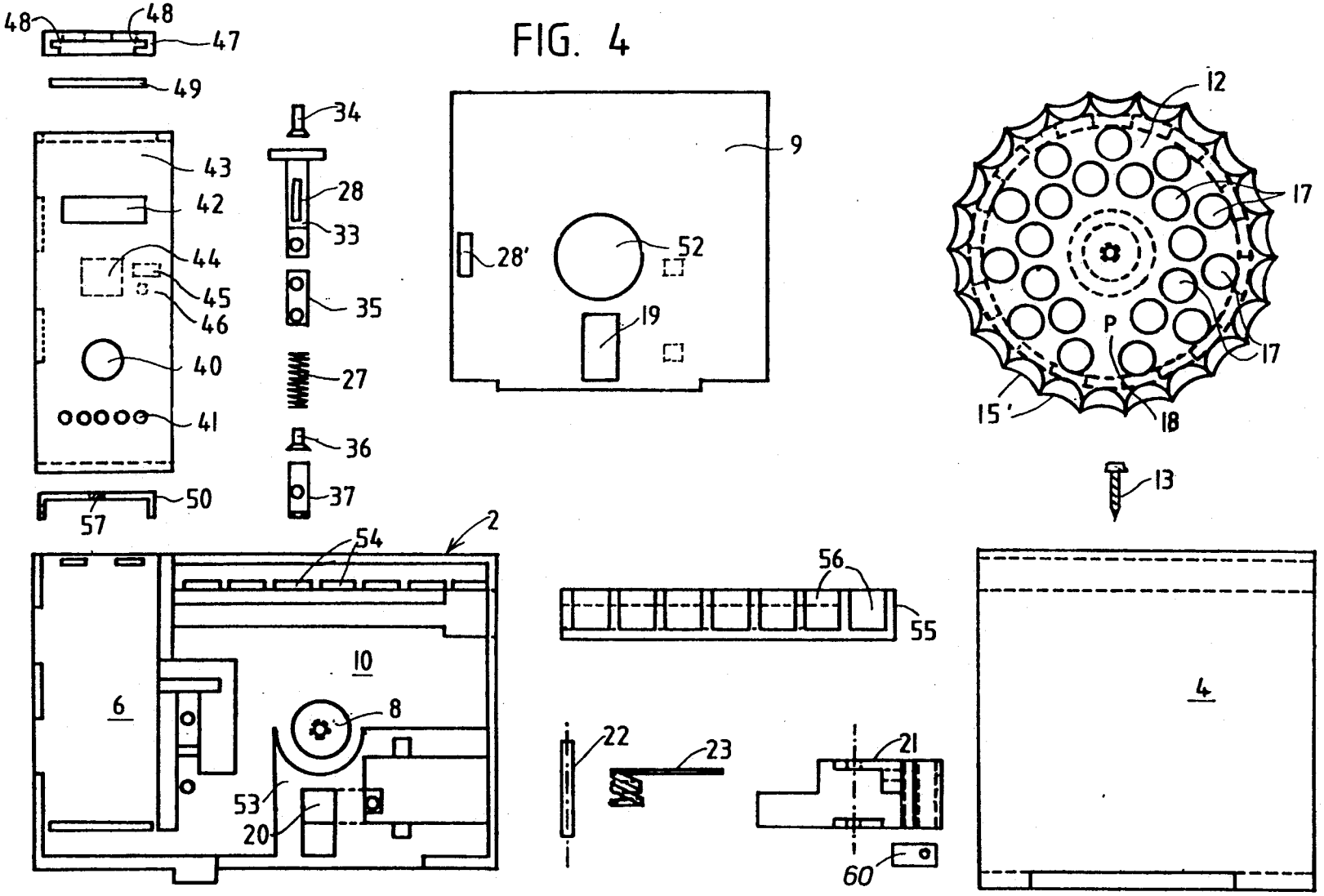
FIG. 4 shows the single construction elements of the apparatus in a dismounted condition, partially in a top view, partially in a side view.

The apparatus comprises a housing 1 of hard-PVC consisting of a bottom 2 and a slide cover 4 which can be shifted along a profile 3 of the bottom 2, as well as of a cover 5 covering a space 6 for accommodation of two cylindrical batteries 7 (suitably at 1.5 volt each). The bottom 2 has an upwardly directed protrusion 8 which abuts an intermediate bottom 9 which together with the bottom 2 confines an annular space 10 surrounding the protrusion 8. A rotary body 11 is supported for rotation between the intermediate bottom 9 and the slide cover 4 an is formed by a disc 12 bearingly supported for rotation around the center of the protrusion 8 by means of a screw 13 which is screwed into the protrusion 8. The screw 13 has an enlarged head 14 which prevents that the disc 12 can drop off the housing 1 after having removed the slide cover 4. The housing 1 and the slide cover 4 surround the disc 12 nearly completely, only at a longitudinal edge of the housing 1 the disc 12 protrudes with its edge 15 through a gap 16 from the housing 1 so that the disc 12 can be rotated by hand without that the slide cover 4 must be removed. In order to facilitate the rotation, the edge 15 is provided with grip recesses 15', particularly in form of ball-calotte-shaped notches. The disc is provided with two rows of receiving openings 17 for the medicaments, each one of these receiving openings 17 being roomy enough for the corresponding portion of the medicament. In order to save as much space as possible, the receiving openings 17 are disposed on the disc 12 alternately in two concentric arcs of a circle. The inner circle of the receiving openings 17 is not closed but leaves out one receiving opening, the purpose of this interruption 18 (FIG. 4) being explained later on. The intermediate bottom 9 covers the receiving opening 17 to below if no medicament must be taken, however, has a dispense opening 19 large enough so that the medicaments can fall out from each receiving opening 17 through the dispense opening 19 into a collecting compartment 20 as soon as the respective receiving opening 17 is positioned above the dispense opening 19 after corresponding rotation of the disc 12. However, when the interruption 18 is disposed above the dispense opening 19, this opening is at least substantially covered. The collecting compartment 20 can be closed on its dispense side by means of a rocker 21 which can be tilted around an axis 22 bearingly supported in the bottom 2 and being pressed by a spring 23 into the closing position. For the dispense of a medicament from the collecting compartment 20, the rocker 21 can be swivelled out of its closing position, if pressure is exerted by hand on the outer end of the rocker 21 against the action of the spring 23, this rocker end engages into a hollow space 24 of the bottom 2.

Figure 1:
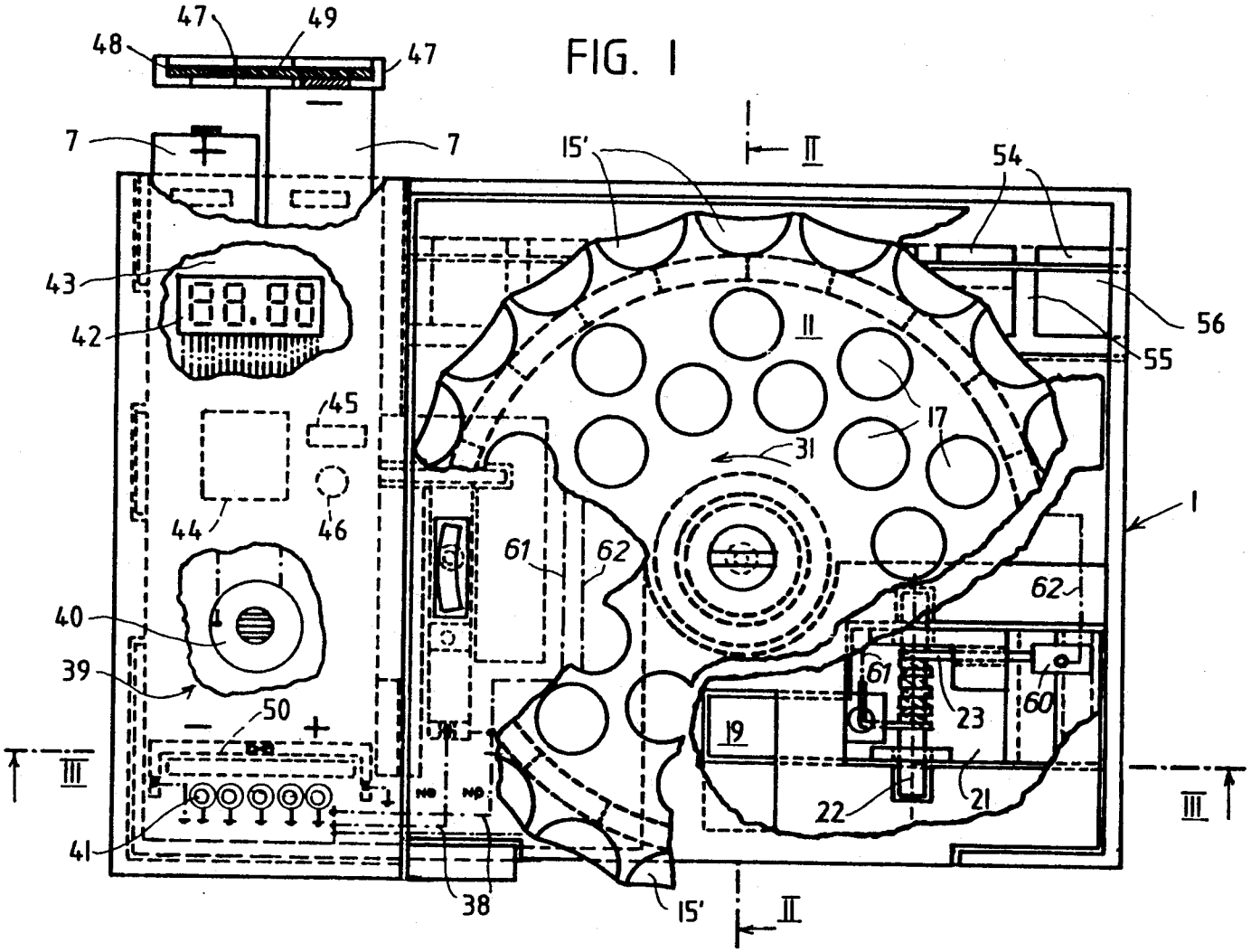
FIG. 1 shows a top view on the apparatus, the cover removed, some elements being shown broken away.

An interlocking means or, respectively, stop means 25 is provided for the disc 12 that ensures that the disc 12 remains always in a rotary position in which either a receiving opening 17 or the interruption 18 is positioned above the dispense opening 19. The interlocking means 25 has a tooth 28 which is abutted by a spring 27 and intersects a slot 28' of the intermediate bottom 9 and engages a gear rim 30 disposed concentrically to the axis 26 of the disc 13 on the bottom side 29 of the disc 12. By a suitable slope of the tooth 28 and by a suitable embodiment of the teeth 28 of the gear rim 30 it is ensured that the disc 12 can be rotated in the counter-clock-sense only, that is in direction of the arrow 31 (FIG. 1). The tooth 28 is fixed to a rocker 33 which is abutted by the spring 27 and is bearingly supported in the bottom 2 to rock around a horizontal axis 32, a contact plate 35 of brass being fixed by means of a rivet 34 to the rocker, which contact plate together with a further contact plate 37 fixed by means of a rivet 36 to the bottom 2 forms a normally open contact switched into a circuit 38 (FIG. 1) of a signal emitter 39. The signal emitter 39 has a buzzer 40 that at pre-programmed moments emits an alarm signal which draws one's attention to the fact that a medicament must be taken. Pre-programming is done at a keyboard 41, the adjusted values can be read at a display 42. The mini-buzzer 40 and the display 42 are disposed on a chip 43 carrying also a microcomputer 44, a quartz resonator 45 with a mini-transformer and a capacitor 46. These members together with an electronic circuit comprised in the chip 43 effect the input and storage of the desired alarm moment as well as the release of an alarm signal by means of the buzzer 40 as soon as a counter counting down from the adjusted alarm moment, reaches the counting value 0. Suitable circuits for that purpose are known per se and therefore do not need further explanation.

The space 6 for accommodation of the two cylindrical batteries 7 can be closed on the front side (insertion side of the batteries) by a cover 47 comprising inwardly a slot guidance 48 for accommodation of a brass plate 49 serving as a tap of a battery voltage. A further brass contact member 50 having an isolation 57 formed by soldering notch engages the front end of the two batteries 7 within the interior of the space 6.

Figure 2:
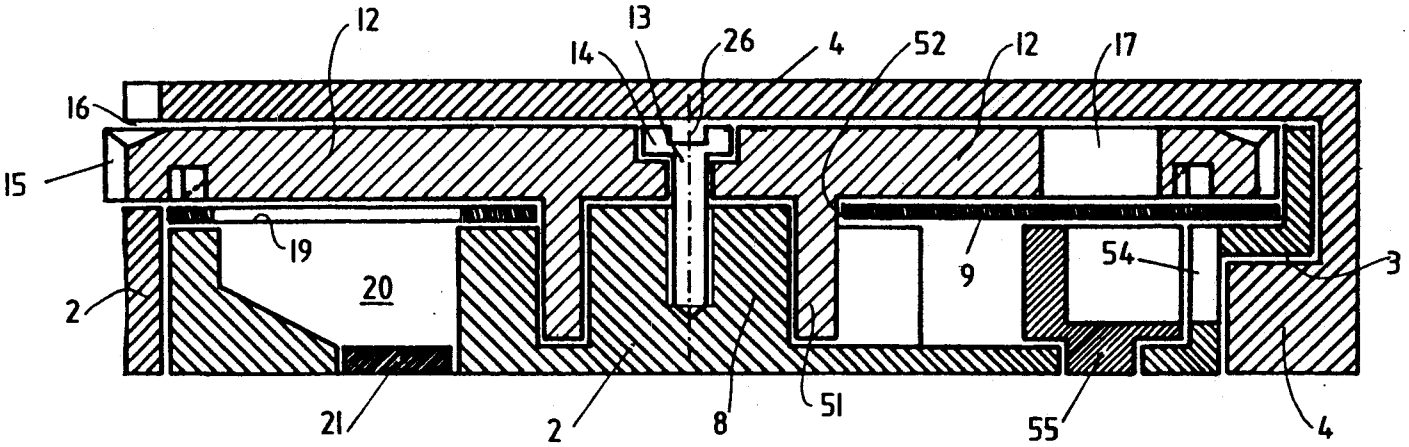
FIG. 2 is a section along the line II—II of FIG. 1 in an enlarged scale.
Figure 3:
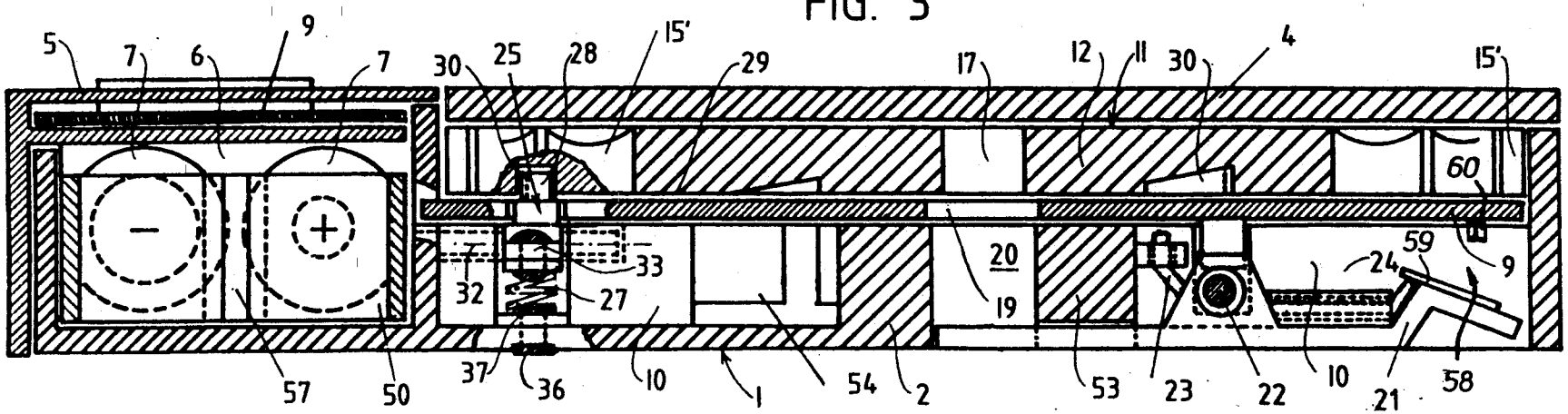
FIG. 3 is a section along the line III—III of FIG. 1 in an enlarged scale, the drawer being drawn out from the housing.

The disc 12 forming a rotary member 11 carries on its bottom side an annular flange 51 (FIG. 2) surrounding the central protrusion 8 of the bottom 2 and serving as a centering for the intermediate bottom 9 that is disposed on the flange 51 by means of a central opening 52. The bottom has further an upwardly directed protrusion 53 (FIG. 3,4) surrounding the collecting compartment 20, said protrusion 53 constituting a further support for the intermediate bottom 9.

At that longitudinal edge which comprises the insert opening for the batteries 7, the housing 1 is provided in its bottom 2 with punched slot holes 54 for accommodation of additional medicaments in form of pills. In the pushed-in position of a drawer 55, these slot holes oppose compartments 56 of the drawer. This drawer 55 may also be used for accommodation of jewels.

The function of the apparatus is as follows:

After removal of the slide cover 4, the disc 12 is rotated in the anti-clockwise sense (arrow 31, FIG. 1) so that the mark "P" (FIG. 4) applied to the disc is disposed above the dispense opening 19 of the intermediate bottom 9. In this position of the disc 12, this opening is closed by the interruption 18 of the inner circle of the receiving openings 17 and by the spacing between two adjacent receiving openings 17 of the outer circle of these openings. The medicaments can now been introduced in the clockwise sense into the corresponding receiving openings 17 of the disc 12. This is done in a zigzag-manner, starting at the first receiving opening 17 (at the left hand) in the outer circle of these openings, then follows the first receiving opening 17 in the inner circle, then the next one in the outer circle and so on. In the illustrated embodiment 21 receiving openings 17 are provided, in conformity to a three-phase- medicament for contraception (always one pill over a period of three weeks). The said introduction ensures that the medicaments are taken in a correct succession or, respectively, the introduction must be adapted to the desired sequence of the medicaments to be taken.

After completion of the insertion process, the slide cover 4 is pushed in laterally from the right side (FIG. 1) into the profile 3 of the housing 1, so that the housing 1 is closed to above. Then no medicaments can get lost. Then, input of the dates is made by means of the keyboard 41, namely the desired dayly alarm time (or, if desired, different alarm times for different days). If the electronic is designed also as a calender and as a clock, the input may also comprise the months and the day or, respectively, the hour and minute. The input datas may be read on the display 42. These processes or, if desired, actuating of a starting key of the keyboard 41 start the counting process of the electronic system, which enters into a waiting loop until the input alarm moment. As soon as this alarm moment is reached, the first alarm is released by means of the buzzer 40. If the person to which the alarm is directed, reacts at once, this person must only rotate the disc 12 in the anti-clockwise sense for one tooth of the toothed rim 30 to the right (FIG. 1) in order to be able to take out the medicament, whereby the first receiving opening 17 filled with a medicament (that of the outer circle) is now disposed exactly above the elongated dispense opening 19. This position is secured by the tooth 28 that resiliently engages the corresponding spacewidth of the gear rim 30. The medicament falls now out of the said receiving openings 17 through the dispense opening 19 into the collecting compartment 20 (FIG. 3) of the bottom 2 and can therefrom be taken off by pressing the rocker 21. The said rotation of the disc 12 for one pitch of the gear rim 30 quits simultaneously the alarm and the circuitry enters a new waiting loop. This is released by the disc 12 that on its rotation presses down the tooth 28 whereby the contact plates 35,37 engage each other and thereby close a circuit which in the electronic circuitry effects the said operations since the current pulse caused by closing the contacts is considered by the control logic means of the evaluation means as a counting pulse. Thereby, the sounds of the buzzer 40 are stopped and a new period is set which (provided that no re-programming is made) shows the same duration as the beforesaid period.

If—by whatever reasons—the alarm emitted by the buzzer 40 is not quitted, the electronic means stops the alarm after 30 seconds and due to the lack of a counting impulse the circuitry enters a new waiting loop of 60 minutes counted from the alarm release. Then, a new alarm sound takes place by means of the buzzer 40, and again for a period of 30 seconds. If also this time the alarm is not quitted, the program is repeated all 60 minutes until the alarm is quitted.

When the last medicament (after 21 days) is taken off, there are two possibilities. Either the disc 12 is rotated in the anti-clockwise sense for a pitch of the gear rim so that the mark "P" is positioned anew above the dispense opening 19, or this does not happen so that the disc 12 remains in the last position reached. In the first case, the alarm is further emitted continuously and—provided that the receiving openings 17 are filled anew with medicaments—there is no interruption of the alarm release and of taking the medicaments. As a rule, this will be the case if the medicament must be dayly taken without intervals, for example medicaments for controlling blood-pressure and the like. In the second case the electronic means enter a pause-waiting loop of exactly 7 days counted from the last counting pulse, if desired less the period omitted at the last alarm quitting so that always the next alarm release happens at the stored hour-minute-combination. This corresponds exactly to the cycle of three- or four-phase birth control pills. During the said interval of one week no alarm is released. If a new alarm sounds after this interval, that remembers to the filling of the apparatus and the disc 12 is again rotated further for a position (mark "P" above the dispense opening 19), what quits the alarm and starts a new 21-day-cycle. After filling the receiving opening 17 with the medicaments, one proceeds further as initially descibed.

For medicaments which have to be taken in other cycles, of course the number of receiving openings 17 can be greater or smaller than 21.

The rocker 21 can be used for closing a further contact 58 (FIG. 3) inserted into a circuit of the signal emitter 39. For this, the rocker 21 carries on its upper side a contact plate 59 cooperating with a counter-contact 60 fixed to the bottom side of the intermediate bottom 9. Current is fed to the contact plate 59 by means of the spiral spring 23. The feed wires 61 or, respectively, 62 leading to the spiral spring 23 or, respectively, to the counter-contact 60 are accommodated in slots in the protrusion 53 of the bottom 2 of the housing. Therefore, the spiral spring 53 has a double function, namely on the one hand it serves as a current feed and on the other hand it moves the rocker 21 back to its starting position.

A conductor branches off directly from the contact plate 37 associated to the other rocker 33 (FIG. 3), because only one scan signal leaves the micro computer 44 for both contact functions (counting rocker 33 and ejecting rocker 21), that is the micro processor emits two different strobe signals and reads both signals by one scan conductor only (one single receiver line cooperating with two outgoing lines). Thereby one conductor and on the board one soldering point are saved.

In the FIGS. 5 and 6, two accidents are shown by way of pulse diagrams, which accidents can be detected and indicated by the described circuitry or, respectively, the related program of the micro processor 44. FIG. 5 relates to an accident supposing that the rotary member 11 has been over-rotated after released alarm moment for a pitch (one receiving opening 17) or more pitches, respectively, receiving openings 17. Signal a shows by the rising edge of the pulse the reach of the alarm moment, the signal level rising from 0 to 1 (low to high). The signal b represents the activation of the buzzer 40 which is activated by the rising edge of the signal a and emits a sound pulse sequence in several intervals. The signal c represents the normal operation (accident-free operation): The rotary body 11 is rotated for a step within the time duration in which the signal a has the value 1 (high). The closed contact of the signal emitter 39 emits then a spike pulse to the input of the microprocessor 44 and returns again to its original position. Thereby the signal a is re-set to 0 (low). However, the trailing edge of signal c re-sets not only the signal a which reaches 1 (high) only when a new alarm moment is reached, but also starts a gate time geneator (signal d) which remains active for some time and serves for controlling accident signals what is described more in detail in the following: Such an accident signal may be indicated by the signal e: It may be supposed that an erroneous second pulse is received in addition to the signal c. In this case the signal e as well as the signal d have the level 1 (high) for a short time, whereby means of an AND-operation (control-layered $1+1=1$) the signal f is created which for the remaining length of the gate duration (signal d on 1) is kept at low (0). The erroneous second counting pulse of the signal e is inverted thereby. This is done by the rising edge of the interfering impulse (second counting impulse in the signal e), at which moment an alarm signal is released in the microcomputer 44, for example a permanent sound at the buzzer 40 and four blinking 9-segments at the display 42 (signal g). This signal indicates an erroneous operation and can only be re-set by setting the alarm clock anew.

The second accident shown in FIG. 6 supposes that the rotary body 11 was turned for a pitch (one receiving opening 17) or, respectively, for several pitches (receiving opening 17) before the alarm moment was reached. The signals a and b correspond to those of FIG. 5. By the signal h the premature pulse is indicated which is released by the premature rotation of the rotary body 11 and by the contact touch at the rockers 21, 33 released thereby, and which activates the signal emitter 39. The trailing edge of the interfering impulse (signal h) sets the alarm task to active (high=1), whereby an alarm sound, for example a permanent sound is released at the buzzer 40, or another signal indicating the accident (signal i). This signal i which indicates an erroneous operation, can be quitted by actuating the rocker 21, the pulses created by the rocker 21 by means of the contact 58 are shown in signal j. For this, it is necessary to actuate the rocker 21 and this forces the user to look into the pill storage, however also a medicament can be prematurely taken out, if this is desired. All further pulses released by the rocker 21 do not have any action until the pre-programmed moment (signals a,b). However, the alarm moment is met as in the normal operation, as far as no re-programming is made. The signal k is a difference signal which occurs from the trailing edge of the first pulse released by the rocker 21 (signal j) and serves for quitting the erroneous alarm and remains until the second pulse of the rocker 21 (signal j), since the pre-programmed alarm must be quitted by the second pulse of the rocker 21 (signal j) (without rotation of the rotary body 11). At this time, the medicament may still be within the pill storage means so that an error is considered, if it is desired to store the pill until the prescribed moment. However, as already mentioned-the pill may also prematurely be taken out of the pill storage means. By the second rocker impulse (signal j) also the signal k is re-set.

I claim:

1. An apparatus for storage and timed taking of a medicament in form of portioned particles, pills, capsules, and the like comprising a storage means for the medicament to be taken and an adjustable electronic signal transmitting means for releasing of alarm signals at desired moments for taking the medicament, the storage means being provided with a plurality of receiving openings for the medicament to be taken over a time interval of some days, said receiving openings being disposed in a circle around a rotation center and being covered by a cover member having a dispense opening, said storage means being rotatable relative to the cover member into different rotary positions related to the receiving openings, in each of which rotary positions one of the receiving openings is disposed at the dispense opening and, when rotating to a new one of these rotary positions, the signal transmitting means is re-set to a new counting cycle, the improvement comprising that the storage means comprises a rotatable body (11) bearingly supported for rotation around an axis (26) and a casing (1), said rotatable body being disposed within said casing, said casing embracing the rotatable body (11) at least in the region of its receiving openings (17) and having the dispense opening (19) therein, said rotatable body including a handling edge (15) protruding from the casing (1) and being arrestable by an interlock means (25) in the different rotary positions, and that an additional rotary position of the rotatable body (11) is provided in which no receiving opening (17) is disposed at the dispense opening (19), the interlocking means (25) being coupled with the signal transmitting means (39) for reset to a new counting cycle.

2. The apparatus as claimed in claim 1, further comprising a receiving compartment (20) for the medicament connected to the dispense opening (19), said compartment having a dispensing side, said compartment including a closure member on the dispensing side thereof in the form of a hand actuated rocker movable between a closing position and an open position.

3. The apparatus as claimed in claim 2, further comprising at least one contact (58) related to the rocker (21), which contact is inserted into a current circuit of the signal transmitting means (39).

4. In the apparatus as claimed in claim 1, the interlocking means (25) being formed by a tooth (28) which is resiliently pressed against a toothed ring (30) of the rotatable body (11) and allows rotation of the rotatable body (11) in one direction only.

5. In the apparatus as claimed in claim 4, the tooth (28) being carried by an abutted rocker (33) which is provided with a normally open contact inserted into a switching circuit (38) of the signal transmitting means.

6. In the apparatus as claimed in claim 1, the signal transmitting means (39) being provided with a counter controlled by the interlocking means (25) for releasing alarm signals at a plurality of subsequent taking moments.

7. In the apparatus as claimed in claim 1, the casing (1) further comprising a slide cover (4) covering the upper side of the receiving openings (17) of the rotatable body (11).

8. In the apparatus as claimed in claim 1, the receiving openings (17) being disposed in at least two concentric circular rows around the center of the rotatable body (11), at least one circular row being provided with an interruption (18) of the series of openings, which interruption (18) in its rotary position of the rotatable body (11) above the dispense opening (19) covers this dispense opening (19) completely.

9. The apparatus according to claim 1, further comprising a non-rotatable intermediate bottom (9) between the rotatable body (11) and a bottom section of the casing (1), the intermediate bottom (9) being intersected by the dispense opening (19).

10. The apparatus as claimed in claim 1 further comprising a drawer (55) for accommodation of additional medicaments and adapted to be pushed into a pushed-in position in the casing (1).

11. In the apparatus as claimed in claim 10, said drawer having a plurality of compartments (56) therein, said casing having a plurality of slots (54) therein opposing the compartments (56) when said drawer is in the pushed-in position thereof, said casing being closed by a slide cover (4).

12. The apparatus as claimed in claim 1, said rotatable body being a disc (12).

* * * * *